United States Patent [19]

Pollin

[11] 4,350,315

[45] Sep. 21, 1982

[54] DEVICE TO DE-SPIN OBJECTS WITH VERY HIGH SPIN

[75] Inventor: Irvin Pollin, Bethesda, Md.

[73] Assignee: The United Staates of America as represented by the Secretary of the Army, Washington, D.C.

[21] Appl. No.: 153,461

[22] Filed: May 27, 1980

[51] Int. Cl.[3] ..... F42B 13/32

[52] U.S. Cl. ..... 244/3.23; 244/3.1

[58] Field of Search ..... 244/3.1, 3.23; 102/504, 102/405

[56] References Cited

U.S. PATENT DOCUMENTS 2,372,383 3/1945 Lee ..... 102/504

OTHER PUBLICATIONS

Fedor, J. V. "Theory and Design Curves for a Yo-Yo De-Spin Mechanism for Satellites," Aug. 1961.

Cornille, Jr.; Henry J., "A Method of Accurately Reducing The Spin Rate of a Rotating Spacecraft,"Oct. 1962.

*Primary Examiner*—Charles T. Jordan

*Attorney, Agent, or Firm*—Nathan Edelberg; Robert P. Gibson; Saul Elbaum

[57] ABSTRACT

A method and apparatus are disclosed which are particularly adapted to quickly de-spin a rapidly rotating object or projectile. Weights are released from the object in a series of distinct stages, thus discarding enough momentum to reduce the spin of the object to a desired minimal value. The weights are released simultaneously by a single release means thereby assuring perfectly symmetrical and synchronized release of the respective weights. The result is a pure de-spin of the object without imparting other motion to the object.

18 Claims, 5 Drawing Figures

DEVICE TO DE-SPIN OBJECTS WITH VERY HIGH SPIN

RIGHTS OF THE GOVERNMENT

The invention described herein may be manufactured, used, and licensed by or for the United States Government for governmental purposes without the payment to me of any royalty thereon.

BACKGROUND OF THE INVENTION

It has been known in the art to utilize a device called a "Yo-Yo" for de-spinning an object in flight. Such a device has been incorporated into satellites and other such apparatus for the purpose of reducing or halting the spin thereof, thereby assuring proper orientation of antennas, etc. attached thereto. The yo-yo de-spin mechanism used in the prior art is essentially two pieces of wire with weights on the ends. These wires are symmetrically wrapped about the equator of a satellite and the weights are secured by release mechanisms. At a predetermined time after satellite spin-up and separation from a launching vehicle, the weights are released, thus discarding enough momentum to reduce the spin of the satellite to a desired minimal value. Such a device is fully described in NASA Technical Note D-708, August 1961.

The device of the NASA publication is designed to reduce the rotation of a satellite from approximately 3 rotations per second (rps) to as near 0 rps as possible. At the present time, no feasible procedure exists to de-spin bodies with initial spins as large as 300 rps. The force applied to the wires of the de-spinning device is proportional to the square of the angular velocity of the spinning body. Therefore, by increasing the angular velocity by a factor of 100, the forces on the wires are increased by a factor of 10,000. Thus, forces exceeding 20,000 lbs. would occur in these wires. Hence, the device shown in the NASA technical bulletin would fail at spins as large as 300 rps.

The devices of the prior art utilize cutting mechanisms to release the weights from the rotating body. The use of such devices results in an inherent lack of simultaneity in the release of the weights, the result of which is an erratic lateral motion being parted to the rotating body. This erratic behavior, a relatively unimportant factor at a rotational velocity of 3 rps, becomes a critical and highly undesirable factor at velocities on the order of 300 rps. Also, inherent minute physical variations resulting from manufacture of the de-spin devices (variations in wire gage, mass of the weight elements, etc.) will result in erratic motion of the rotating body. Such minor variations are relatively unimportant at low rotational speeds but become critical at very high rotational velocities. Therefore, the prior art devices and techniques for de-spinning a rotating object are not suitable for application to objects rotating at very high angular velocities.

It is therefore an object of this invention to provide means to de-spin an object which overcomes the drawbacks of the prior art devices.

It is an object of this invention to provide means to rapidly and dependably reduce the rotational speed of an object rotating at a very rapid rate.

It is another object of this invention to provide means capable of rapidly reducing the spin rate of an object without imparting any imbalance or other motions thereto.

Yet another object of this invention is to provide a device capable of de-spinning a rapidly rotating body, such device being suitable for mass production yet sufficiently accurate to perform its function reliably and accurately.

SUMMARY OF THE INVENTION

The unattended expendable jammer (UEJ) is an electronic device which is used to interfere with radio communications. A number of UEJ devices are released during the flight of a 155 mm artillerly shell from the interior of the shell. Each UEJ must be rapidly decelerated during its descent to the ground so that it may be accurately set down in a desired location. Each UEJ is capable of jamming radio communications over a definitive area. A number of such jammers are used in a grid or network to increase the effective jammed area. In order to be effective, each jammer is required to land at a proper position in a particular orientation so as to be able to deploy an antenna incorporated into the device. For these reasons, precision in the ground descent is required.

The attitude, or orientation, of highly spinning bodies such as artillery shells is exceedingly difficult to alter. De-spinning is necessary to accomplish a change of orientation and control of the in-flight trajectory of the UEJ. The purpose of the invention is to provide means to de-spin ordnance hardware from an initial spin of up to 300 rps to a final spin of 3 rps or less, as required.

The apparatus comprises a series of sets of cords, or weights attached by cords to the rotating object. When released, the masses are allowed to unwind about the body of the object, pulling away from the body due to centrifugal force. As the cords unwind to the full length and attain a position normal to the tangent drawn to the surface of the projectile, each cord is simultaneously released and allowed to escape. The angular momentum of the system is conserved, so that the reduction of angular momentum of the spinning body equals the momentum imparted to the masses expended.

The method of the present invention involves releasing weights or masses from the rotating body in several stages. The configuration of the first or earlier stages is such that it is capable of withstanding the relatively great forces which result from the rapid rotation of the object. Means may be provided so that the termination of operation of a given stage will initiate the operation of a subsequent stage of the device.

The present invention also comprises means to assure simultaneous release of balanced portions of the expendable mass from symmetrically opposite positions on the rotating body at each stage of operation of the device. The improved release means comprises a detonator and explosive cord means extending from the detonator to a position proximate each of the expendable masses. Detonation of the explosive cords results in the simultaneous release of each of the expendable masses at any given stage of operation of the inventive de-spin device.

DETAILED DESCRIPTION OF THE INVENTION

Figure 1A:
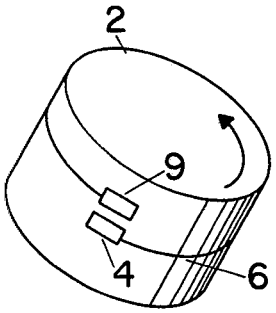
FIGS. 1A and 1B illustrate the manner in which a yo-yo device acts to reduce the angular velocity and momentum of a rotating object.
Figure 1B:
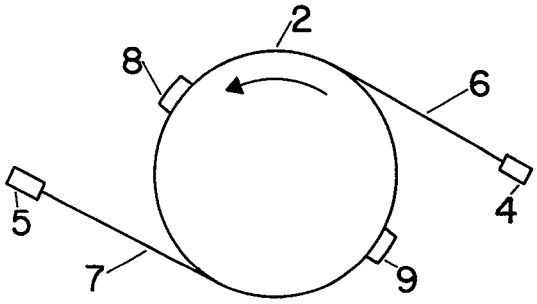

FIGS. 1A and 1B illustrate the manner in which a de-spinning device reduces the angular momentum of a rotating object. Attached to a rotating body or satellite 2 are weights 4 and 5. The weights are secured to the exterior of the body by a release mechanism and have attached thereto cord elements 6 and 7, respectively. The cords are wrapped about the exterior of the body and are releasably attached thereto by means of elements 8 and 9, respectively. In operation, devices associated with the weights 4 and 5 release the weights at approximately the same time. The centrifugal force resulting from the rotation of the body causes the weights to be flung outwardly, thus unwinding cords 6 and 7 from the body. The unwinding weights and cords exert a pulling or retarding effect on the spin of the rotating body. When the cord reaches a position perpendicular to the surface of the body, the cords are released thus discarding enough momentum to significantly reduce the rate of rotation of the body.

This system works satisfactorily for objects such as satellites, which normally are rotating at a maximum of 3–5 rps. However, as previously noted, this arrangement is not suitable for use with projectiles or other such objects which are rotating at approximately 300 rps.

The present invention overcomes the drawbacks of prior art devices in several ways. The apparatus of the present invention is capable of reducing the rate of rotation of a spinning body in several stages, and is therefore capable of de-spinning the body in a controlled and predictable fashion. Furthermore, the present invention provides apparatus which is capable of sustaining the tremendous forces imparted thereto by a very rapidly rotating object. The present invention also provides means to assure that the weights released from the spinning body will be released at precisely the same instant of time (within one micro-second), providing de-spin with negligible lateral motion.

The apparatus of the present invention is required to de-spin a rapidly rotating object in a very controlled manner and within a span of time of one second or less. Because of the tremendous forces involved, the required strength of a single staged device, and the accuracy required, an apparatus built in a fashion similar to that of the prior art device could not be successful. The present invention provides the required strength and accuracy of the apparatus by releasing mass elements from the rotating object in several stages. As desired, each stage could reduce the rate of spin of the body by approximately 60 to 90 percent. The effect of any minor imprecision in any stage due to mass production techniques is therefore minimized. Since the final value of spin is the product of the reduced spins provided by each stage, the effect of any imprecision in a particular stage is dramatically reduced. Also, forces acting on the second and sebsequent stages can be dramatically reduced due to the spin reduction provided by the initial stage.

Figure 2:
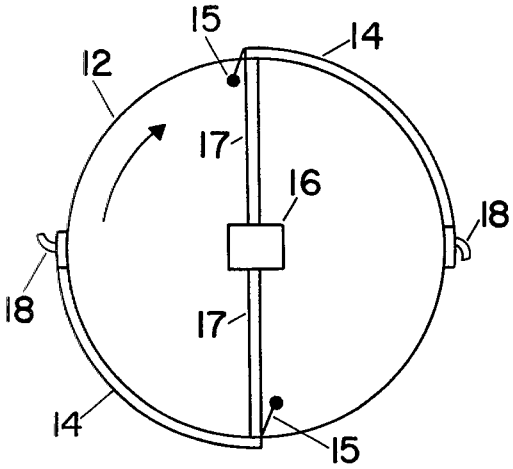
FIG. 2 illustrates a first configuration of the de-spinning device of the present invention.

FIG. 2 illustrates a form of the invention which is particularly suitable for use as the first stage of the de-spinning device. FIG. 2 is a sectional view of an object 12 which is rotating in a clockwise direction. Cords 14 comprise expendable mass elements, and are releasably secured to the body 12 by means of element 18, to be more fully described hereinafter. At the end of each cord which is opposite to the means 18, the cord is retained in position on the exterior of the rotating object by a retaining means illustrated schematically at 15. Means 15 may comprise a tie-down cord or other similar means.

A detonating means 16 is provided in the rotating object 12. Joined to the detonating device 16 are explosive cord elements 17. Each cord 17 extends from the detonator to a position adjacent respective retaining elements 15. Each cord 17 comprises a single mild detonating cord enclosed within a lead sheath. On a signal from the detonator 16, the centers of the respective detonating cords are ignited and the cords rapidly burn toward each of the respective ends adjacent the retaining element 15. The burning of the detonating cord causes the lead sheath to rapidly expand and burst outwardly, thereby severing or rupturing the retaining means 15. Because of the rapid speed of burning along the detonating cords, simultaneity of severances of the respective retaining means is accomplished to within about one micro-second.

Centrifugal forces operating on the released cords 14 cause these cords to be flung outwardly from the surface of the projectile. The cords then unwind, expending momentum and reducing the angular rate of spin of the projectile, as previously described. Since there are no weight elements attached to the cords, the forces acting thereon are substantially reduced enabling the cord to absorb the momentum of the projectile without breaking. It is desirable, although not essential, to utilize cords without weights attached thereto in the first stage of the de-spinning apparatus. The absence of the weights reduces the stress on the cords thereby avoiding breakage which would result in severe imbalance and lateral motion of the rotating object.

Figure 3:
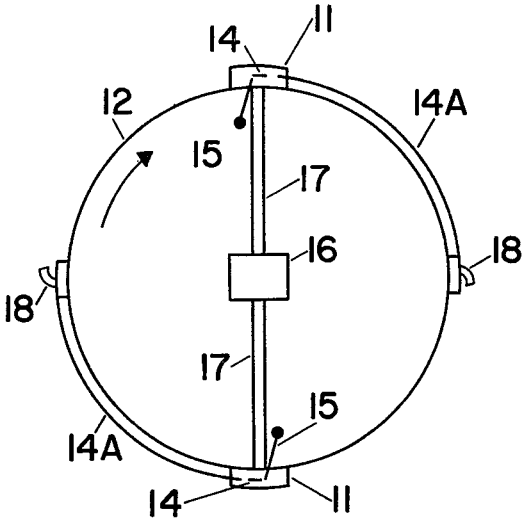
FIG. 3 illustrates another configuration of the de-spinning device of the present invention.

FIG. 3 illustrates another form of the invention. This embodiment, comprising weights attached to the cords 14A, is more suitable for use once the angular rate of the projectile is substantially reduced. The initial stage represented in FIG. 2 is shown in dashed outline in FIG. 3. This embodiment is also suitable for use as an initial stage or the sole stage of a de-spinning device which is utilized in conjunction with a body which is spinning at a more moderate rate. The configuration of FIG. 3 is similar to that of FIG. 2, with the addition of weights, or mass elements 11 attached to the cords 14A. In this embodiment, the weight elements 11 are retained in position on the exterior of the object by means of the retaining elements 15. Again, detonator 16 is provided and explosive cords 17 extend therefrom to a position adjacent the respective element 15. Upon detonation of the cords, the weights will be released in order to reduce the angular momentum and velocity of the rotating object, in the manner previously described.

In the embodiments of FIGS. 2 and 3, a single explosive cord 17 has been illustrated as being associated with each retaining means 15. It is to be understood that additional explosive cords may be utilized in conjunction with each retaining means in order to assure severance and release of the expendable mass element. Two or three detonator cords may be positioned around the retaining means 15 in order to assure that the retaining means will be ruptured upon explosion of the lead sheaths of the respective cords.

Figure 4:
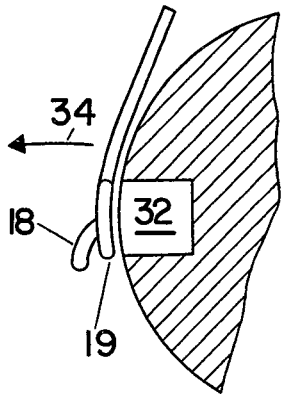
FIG. 4 illustrates in detail a suitable embodiment of the means for releasably attaching the cord elements to the exterior of the rotating body.

FIG. 4 illustrates in greater detail means 18 for releasably attaching the cord elements to the exterior of the object. Means 18 comprises generally a hook-shaped element for retaining a collar 19 attached to the end of the cord. As the position of the cord changes in response to the unwinding thereof, as indicated by arrow 34 in FIG. 4, the cord will attain a position which is substantially perpendicular to the exterior surface of the object and the angular velocity of the cord will be greater than that of the object. At that time the collar 19 will slip off the end of hook 18, thus releasing the cord from the rotating body.

Reference numeral 32 schematically illustrates a switching device which may be associated with hook means 18. The switching device may be responsive to the relief of tension associated with the release of collar 19 from hook 18, and may provide a signal for actuation of subsequent stages of the de-spinning apparatus. Alternatively, subsequent stages could be initiated by preprogrammed electrical means.

The amount by which the ejected masses will reduce the angular momentum and thus the angular velocity of an object depends upon the size of the masses, cord lengths, and the moment of inertia and geometry of the spinning body. These mathematical relationships are conventional, and are taught in Kaplan, *Modern Spacecraft Dynamics and Control,* Wiley, 1976, pgs. 188–192.

The above invention has been described with reference to a body of circular geometry. For practical reasons, bodies with high spin are generally circular. However, the invention is in no way limited in its application to circular spinning bodies or bodies of any particular geometry. It is for this reason, as well as the fact that obvious changes may be made by one of ordinary skill in the art, that I do not desire to be limited to the details shown in the accompanying drawings.

I claim:

1. A method of de-spinning a body rotating at a very rapid rate, comprising the steps of:

attaching a set of expendable masses to the body, each member of the set comprising two identical masses disposed symmetrically on the body, and sequentially detaching each member of the set of expendable masses.

2. A method, as recited in claim 1, wherein the step of attaching is accomplished by:

releasably attaching a first end of each of the two identical masses of each member of said set to the body; and releasably attaching a second end of each of the two identical masses of each member of the set to the body.

3. A method, as recited in claim 2, wherein the step of sequentially detaching is accomplished by:

releasing simultaneously the first ends of the two identical masses of a member of the set wherein the two identical masses tend to attain a position normal to the direction of rotation of the body;

releasing simultaneously the second ends of the two identical masses of the member of the set when the position normal to the direction of rotation is substantially attained;

releasing simultaneously the first ends of the two identical masses of a next member of the set wherein the two identical masses tend to attain a position normal to the direction of rotation of the body; and releasing simultaneously the second ends of the two identical masses of the next member of the set when the position normal to the direction of rotation is substantially attained.

4. A method, as recited in claim 3, wherein the step of releasably attaching a first end of each of two identical masses of each member of the set is accomplished by detaining the first end with a severable device.

5. A method, as recited in claim 4, wherein the step of releasing simultaneously the first ends of the two identical masses of each member of the set is accomplished by explosively severing the severable device.

6. A method, as recited in claim 5, wherein the step of simultaneously releasing the second ends of the two identical masses of each member of the set is accomplished by hooking the second ends to a hooking device which allows the second ends to be released upon attainment of the position substantially normal to the direction of rotation of the body.

7. A method, as recited in claim 6, wherein the step of simultaneously releasing the first ends of the two identical masses of the next member of the set is accomplished by sensing the release of the second ends of a preceding member of the set of expendable masses.

8. A method, as recited in claim 7, wherein the step of sensing the release of the second ends is accomplished by measuring a difference of centrifugal force at the hooking device.

9. A device for de-spinning a body rotating at a very rapid rate, comprising:

means for attaching a set of expendable masses to the body, each member of the set comprising two identical masses disposed symmetrically on the body; and means for sequentially detaching each member of the set of expendable masses.

10. A device, as recited in claim 9, wherein said means for attaching comprises:

means for releasably attaching a first end of each of the two identical masses of each member of said set to the body; and means for releasably attaching a second end of each of the two identical masses of each member of said set to the body.

11. A device, as recited in claim 10, wherein said means for sequentially detaching comprises:

means for releasing simultaneously the first ends of the two identical masses of a member of the set wherein the two identical masses tend to attain a position normal to the direction of rotation of the body;

means for releasing simultaneously the second ends of the two identical masses of the member of the set when the position normal to the direction of rotation is substantially attained;

means for releasing simultaneously the first ends of the two identical masses of a next member of the set wherein the two identical masses tend to attain a position normal to the direction of rotation of the body; and means for releasing simultaneously the second ends of the two identical masses of the next member of the set when the position normal to the direction of rotation of the body is substantially attained.

12. A device, as recited in claim 11, wherein the means for releasably attaching the first ends of each of the two identical masses of each member of said set comprises severable detaining devices.

13. A device, as recited in claim 12, wherein the means for releasing simultaneously the first ends of each of the two identical masses of each member of said set comprises explosive means for severing said severable detaining devices.

14. A device, as recited in claim 13, wherein said means for simultaneously releasing the second ends of the two identical masses of each member of the two identical masses of each member of said set comprises a hooking device which allows the second ends to be released upon attainment of the position substantially normal to the direction of rotation of the body.

15. A device, as recited in claim 14, wherein the means for simultaneously releasing the first ends of the two identical masses of the next member of said set comprises:

means for sensing the release of the second ends of a preceding member of said set; and means for activating said explosive means to release said first ends of said next member of said set.

16. A device, as recited in claim 15, wherein said means for sensing the release of the second ends of a preceding member of said set comprises means for measuring a difference of centrifugal force at said hooking device.

17. A device, as recited in claim 16, wherein at least one member of said set comprises two identical cords comprising said two identical masses.

18. A device, as recited in claim 17, wherein at least one member of said set comprises two identical cords each with a first and second ends, with identical weights attached to said first ends said cords and weights comprising said two identical masses with said first ends of said cords corresponding to said first ends of said two identical masses.

* * * * *